United States Patent [19]

Salazar, Jr. et al.

[11] Patent Number: 4,702,451

[45] Date of Patent: Oct. 27, 1987

[54] EYEGLASSES HOLDER

[76] Inventors: Don Salazar, Jr.; George Spector, both of 233 Broadway, RM 3615, New York, N.Y. 10007

[21] Appl. No.: 778,401

[22] Filed: Sep. 20, 1985

[51] Int. Cl.[4] ..... A47F 5/00

[52] U.S. Cl. ..... 248/309.1; D16/129; 206/5; 248/DIG. 2

[58] Field of Search ..... 248/309.1, 309.2, 205.3, 248/316.8, 339, 303, DIG. 2; D6/566, 569, 567, 553; D16/129; 206/5, 477, 480, 483

[56] References Cited

U.S. PATENT DOCUMENTS

| | | | |
|---|---|---|---|
| 2,104,612 | 1/1938 | Droll | 248/DIG. 2 X |
| 2,467,251 | 4/1949 | Bowman | 248/DIG. 2 X |
| 2,479,115 | 8/1949 | Inman | 248/303 X |
| 2,688,395 | 9/1954 | Gay, Jr. et al. | 206/5 R |
| 3,259,348 | 7/1966 | Dann | 248/205.3 |
| 3,519,138 | 7/1970 | Murray | 248/DIG. 2 X |
| 3,550,890 | 12/1970 | Kemp | 248/316.8 X |

FOREIGN PATENT DOCUMENTS

| | | | |
|---|---|---|---|
| 1258283 | 3/1961 | France | 248/DIG. 2 X |
| 233139 | 10/1944 | Switzerland | 248/205.3 |
| 415105 | 12/1966 | Switzerland | 248/DIG. 2 X |

*Primary Examiner*—J. Franklin Foss
*Assistant Examiner*—David L. Talbott

[57] ABSTRACT

An eyeglass holder is provided and consists of a plate member affixed to a vertical flat surface and a holding structure mounted to the plate member for holding a bridge of a pair of eyeglasses in a secured position.

1 Claim, 5 Drawing Figures

EYEGLASSES HOLDER

BACKGROUND OF THE INVENTION

The instant invention relates generally to supports for eyeglasses and more specifically it relates to an eyeglass holder.

Numerous supports for eyeglasses have been provided in prior art that are adapted to hold eyeglasses when not in use. For example, U.S. Pat. Nos. 2,104,612; 2,226,684 and 2,884,220 all are illustrative of such prior art. While these units may be suitable for the particular purpose to which they address, they would not be as suitable for the purpose of the present invention as heretofore described.

SUMMARY OF THE INVENTION

A principle object of the present invention is to provide an eyeglass holder that will engage the bridge of a pair of eyeglasses and be affixed to a flat wall surface such as in a bedroom or the like.

Another object is to provide an eyeglass holder that will engage the bridge and frame of a pair of eyeglasses to keep the eyeglasses in a secured position.

An additional object is to provide an eyeglass holder that is waterproof so that the eyeglass holder can be affixed to a shower wall surface such as in a bathroom or the like.

A further object is to provide an eyeglass holder that is economical in cost to manufacture.

A still further object is to provide an eyeglass holder that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
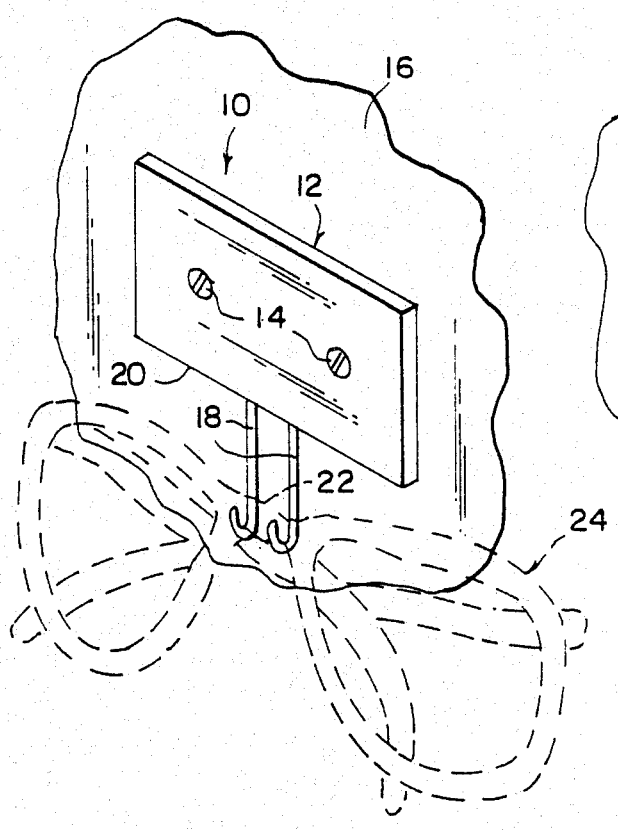
FIG. 1 is a perspective view of a first embodiment of the invention mounted to a wall with screws.

Turning now descriptively to the drawings, in which similar reference characters denote similar elements throughout the several views, FIG. 1 illustrates an eyeglass holder 10 which consists of a plate member 12, two screws 14, 14 are mounted through the plate member 12 and into a vertical flat surface 16 for affixing the plate member 12 to the vertical flat surface 16.

A pair of elongated J-shaped members 18, 18 are mounted in spaced parallel relationship from bottom edge 20 of the plate member 12 for holding a bridge 22 of a pair of eyeglasses 24 shown in phantom.

Figure 2:
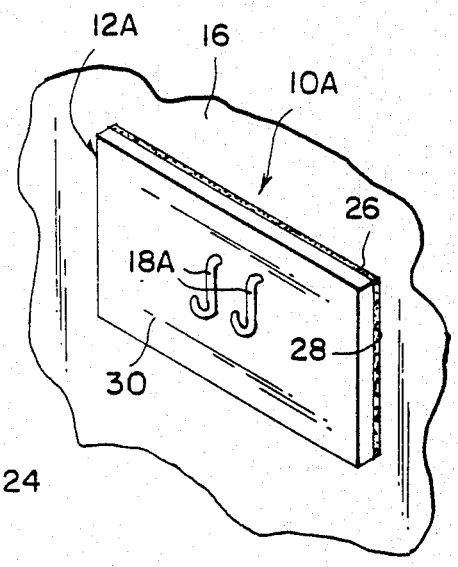
FIG. 2 is a perspective view of a second embodiment mounted to a wall with adhesive.

FIG. 2 shows a first modification 10A of the eyeglass holder. Pressure sensitive adhesive material 26 is placed onto back surface 28 of the plate member 12A for affixing the plate member 12A to the vertical flat surface 16.

A pair of J-shaped members 18A are mounted in spaced parallel relationship from front 30 of the plate member 12A for holding the bridge 22 of the pair of eyeglasses 24.

Figure 3:
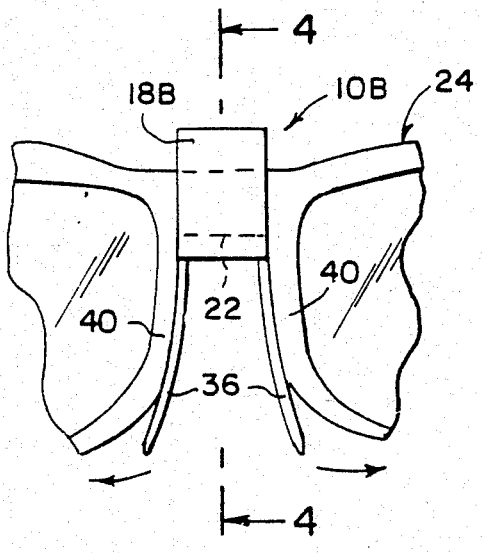
FIG. 3 is a front view of a third embodiment having a pair of spring holding fingers to secure the eyeglasses.
Figure 4:
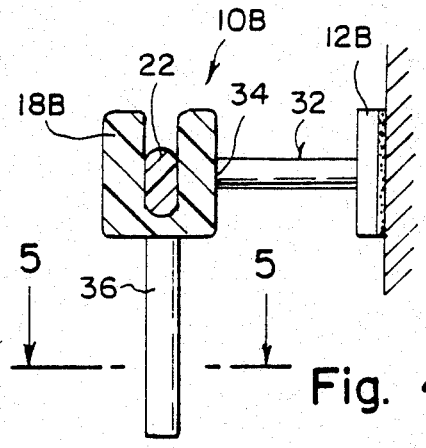
FIG. 4 is a cross sectional view taken along line 4—4 in FIG. 3.
Figure 5:
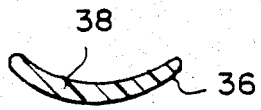
FIG. 5 is an enlarged cross sectional view taken along line 5—5 in FIG. 4 showing the curvature of one of the spring holding fingers.

FIGS. 3, 4 and 5 show a second modification 10B of the eyeglass holder. An arm 32 extends horizontally from the plate member 12B. A U-shaped member 18B is affixed to free end 34 of the arm 32 for holding the bridge 22 of the pair of eyeglasses 24.

A pair of spring holding fingers 36, 36 are provided. Each finger 36 has a C-shaped cross section 38 (as best seen in FIG. 5 ) and extends generally downwardly from one side of the U-shaped member 18B to engage frame 40 of the eyeglasses 24 to keep the eyeglasses in a secured position.

The main use of the eyeglass holders 10, 10A and 10B is to avoid breaking the eyeglasses 24 when a person goes to bed for when taking a shower/bath.

The plate member 12 can be made out of metal such as brass, while plate member 12A and the complete eyeglass holder 10B can be madeout of plastic or colored plexiglass with name of person ingraved thereon. The J-shaped members 18 and 18A can be plastic coated. The eyeglass holders 10, 10A and 10B can be waterproofed for use near showers and bathtubs.

The J-shaped members 18 and 18A could be made flexible and the eyeglass holders utilized for automobiles, trains, home, office, workshop and similar places.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An eyeglass holder which comprises:

(a) a plate member;

(b) means for affixing said plate member to a vertical flat surface;

(c) means for holding a bridge of a pair of eyeglasses, said holding means mounted to said plate member; and (d) spaced resilient means extending from the second said means for engaging the eyeglasses frame to secure said eyeglasses on said holder, wherein said holding means includes:

(e) an arm extending horizontally from said plate member;

(f) a U-shaped member affixed to a free end of said arm for holding said bridge of said pair of eyeglasses spaced from said plates, wherein the third said means comprises:

(g) a spaced pair of spring holding fingers, each said finger having C-shaped cross section extending tangentially divergingly downward from said U-shaped member to engage the frame of said eyeglasses to keep said eyeglasses in a secured position.

* * * * *